US005975089A

United States Patent [19]

Simon

[11] Patent Number: 5,975,089

[45] Date of Patent: Nov. 2, 1999

[54] HAIR BRUSH APPLICATOR

[76] Inventor: Joseph T Simon, 3389 92nd St., Byron Center, Mich. 49315

[21] Appl. No.: 09/195,951

[22] Filed: Nov. 19, 1998

[51] Int. Cl.[6] ..... A45D 24/22; A45D 24/00; A46B 11/00; A46B 11/04

[52] U.S. Cl. ..... 132/113; 132/112; 132/114; 132/219; 401/281; 401/28

[58] Field of Search ..... 132/113, 112, 132/219, 114, 116; 401/281, 28

[56] References Cited

U.S. PATENT DOCUMENTS

| | | | |
|---|---|---|---|
| 1,733,144 | 10/1929 | Walker | 401/281 |
| 2,647,490 | 8/1953 | Twiet | 401/281 |
| 3,457,928 | 7/1969 | Kurshenoff | 132/113 |
| 3,961,635 | 6/1976 | Miya | 132/113 |
| 4,209,027 | 6/1980 | Morganroth | 401/281 |
| 4,605,026 | 8/1986 | Nolin | 132/112 |
| 4,846,201 | 7/1989 | Fuchs et al. | 132/212 |
| 5,119,838 | 6/1992 | Nakazima | 132/108 |

*Primary Examiner*—John J. Wilson
*Assistant Examiner*—Robyn Doan

[57] ABSTRACT

A hair brush applicator for applying flowable hair care products such as hair conditioner and styling gel to the hair of a user. The hair brush applicator includes a hair brush with a handle portion and a head portion. The handle portion of the hair brush has a chamber therein. The head portion of the hair brush has a plurality of bristles outwardly extending from the front face of the hair brush. The bristles of the head portion comprise a plurality of narrow bristles and a plurality of wide bristles. Each of the wide bristles is tubular and has an open root coupled to the head portion and terminates at a closed tip. The hair brush has a passage therein fluidly connecting the chamber adjacent the neck portion to the open roots of the wide bristles. Each of the wide bristles has a plurality of lateral apertures positioned between the root and tip of the respective wide bristle. The hair brush has a rotatably mounted disk blocking the passage of the hair brush. The disk has a plurality of bores therethrough. The disk is rotatable to permit selective alignment of each of the bores of the disk with the passage of the hair brush to fluidly connect the chamber to the wide bristles through the aligned bore.

17 Claims, 2 Drawing Sheets

HAIR BRUSH APPLICATOR

BACKGROUND OF THE INVENTION

1. Field of the Invention

The present invention relates to hair care product applicators and more particularly pertains to a new hair brush applicator for applying flowable hair care products such as hair conditioner and styling gel to the hair of a user.

2. Description of the Prior Art

The use of hair care product applicators is known in the prior art. More specifically, hair care product applicators heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,090,522; U.S. Pat. No. 3,964,501; U.S. Pat. No. 2,228,213; U.S. Pat. No. 2,279,708; U.S. Pat. No. 3,636,963; and U.S. Pat. No. Des. 256,294.

While these devices fulfill their respective, particular objectives and requirements, the aforementioned patents do not disclose a new hair brush applicator. The inventive device includes a hair brush with a handle portion and a head portion. The handle portion of the hair brush has a chamber therein. The head portion of the hair brush has a plurality of bristles outwardly extending from the front face of the hair brush. The bristles of the head portion comprise a plurality of narrow bristles and a plurality of wide bristles. Each of the wide bristles is tubular and has an open root coupled to the head portion and terminates at a closed tip. The hair brush has a passage therein fluidly connecting the chamber adjacent the neck portion to the open roots of the wide bristles. Each of the wide bristles has a plurality of lateral apertures positioned between the root and tip of the respective wide bristle. The hair brush has a rotatably mounted disk blocking the passage of the hair brush. The disk has a plurality of bores therethrough. The disk is rotatable to permit selective alignment of each of the bores of the disk with the passage of the hair brush to fluidly connect the chamber to the wide bristles through the aligned bore.

In these respects, the hair brush applicator according to the present invention substantially departs from the conventional concepts and designs of the prior art, and in so doing provides an apparatus primarily developed for the purpose of applying flowable hair care products such as hair conditioner and styling gel to the hair of a user.

SUMMARY OF THE INVENTION

In view of the foregoing disadvantages inherent in the known types of hair care product applicators now present in the prior art, the present invention provides a new hair brush applicator construction wherein the same can be utilized for applying flowable hair care products such as hair conditioner and styling gel to the hair of a user.

The general purpose of the present invention, which will be described subsequently in greater detail, is to provide a new hair brush applicator apparatus and method which has many of the advantages of the hair care product applicators mentioned heretofore and many novel features that result in a new hair brush applicator which is not anticipated, rendered obvious, suggested, or even implied by any of the prior art hair care product applicators, either alone or in any combination thereof.

To attain this, the present invention generally comprises a hair brush with a handle portion and a head portion. The handle portion of the hair brush has a chamber therein. The head portion of the hair brush has a plurality of bristles outwardly extending from the front face of the hair brush. The bristles of the head portion comprise a plurality of narrow bristles and a plurality of wide bristles. Each of the wide bristles is tubular and has an open root coupled to the head portion and terminates at a closed tip. The hair brush has a passage therein fluidly connecting the chamber adjacent the neck portion to the open roots of the wide bristles. Each of the wide bristles has a plurality of lateral apertures positioned between the root and tip of the respective wide bristle. The hair brush has a rotatably mounted disk blocking the passage of the hair brush. The disk has a plurality of bores therethrough. The disk is rotatable to permit selective alignment of each of the bores of the disk with the passage of the hair brush to fluidly connect the chamber to the wide bristles through the aligned bore.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new hair brush applicator apparatus and method which has many of the advantages of the hair care product applicators mentioned heretofore and many novel features that result in a new hair brush applicator which is not anticipated, rendered obvious, suggested, or even implied by any of the prior art hair care product applicators, either alone or in any combination thereof.

It is another object of the present invention to provide a new hair brush applicator which may be easily and efficiently manufactured and marketed.

It is a further object of the present invention to provide a new hair brush applicator which is of a durable and reliable construction.

An even further object of the present invention is to provide a new hair brush applicator which is susceptible of a low cost of manufacture with regard to both materials and labor, and which accordingly is then susceptible of low prices of sale to the consuming public, thereby making such hair brush applicator economically available to the buying public.

Still yet another object of the present invention is to provide a new hair brush applicator which provides in the apparatuses and methods of the prior art some of the advantages thereof, while simultaneously overcoming some of the disadvantages normally associated therewith.

Still another object of the present invention is to provide a new hair brush applicator for applying flowable hair care products such as hair conditioner and styling gel to the hair of a user.

Yet another object of the present invention is to provide a new hair brush applicator which includes a hair brush with a handle portion and a head portion. The handle portion of the hair brush has a chamber therein. The head portion of the hair brush has a plurality of bristles outwardly extending from the front face of the hair brush. The bristles of the head portion comprise a plurality of narrow bristles and a plurality of wide bristles. Each of the wide bristles is tubular and has an open root coupled to the head portion and terminates at a closed tip. The hair brush has a passage therein fluidly connecting the chamber adjacent the neck portion to the open roots of the wide bristles. Each of the wide bristles has a plurality of lateral apertures positioned between the root and tip of the respective wide bristle. The hair brush has a rotatably mounted disk blocking the passage of the hair brush. The disk has a plurality of bores therethrough. The disk is rotatable to permit selective alignment of each of the bores of the disk with the passage of the hair brush to fluidly connect the chamber to the wide bristles through the aligned bore.

Still yet another object of the present invention is to provide a new hair brush applicator that lets a user control the amount of hair care product applied to their hair.

Even still another object of the present invention is to provide a new hair brush applicator that massages hair care products into the hair and scalp of a user as the brush traverses the scalp of the user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
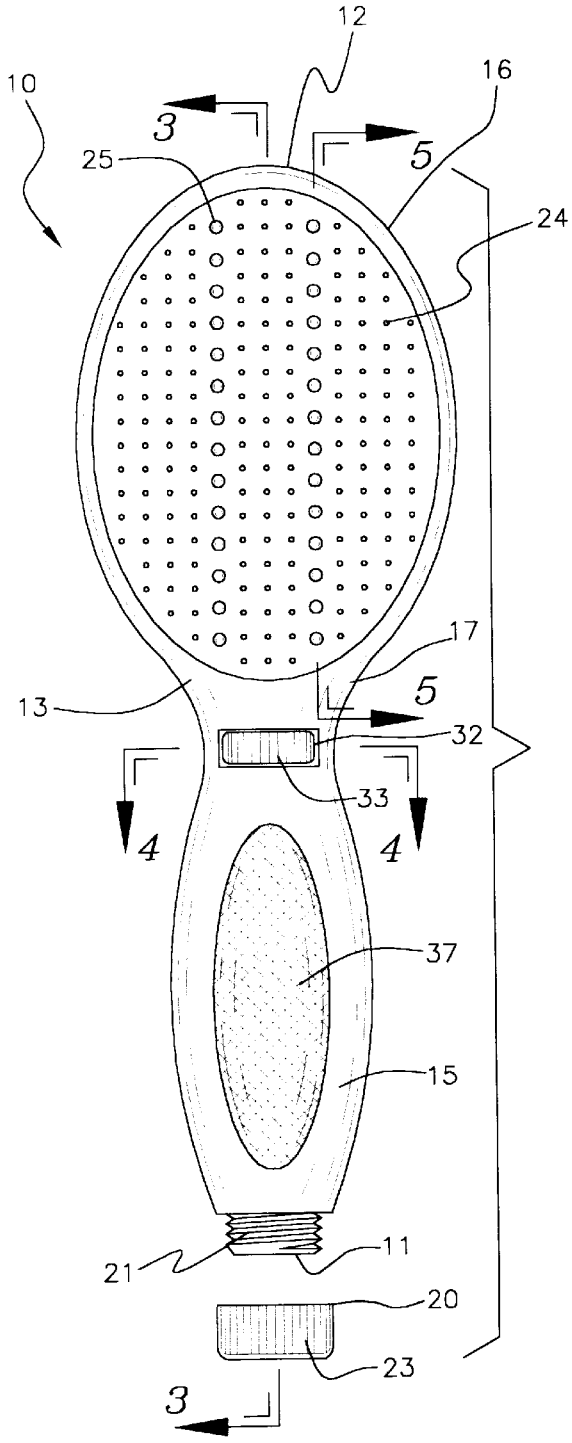
FIG. 1 is a schematic exploded front side view of a new hair brush applicator according to the present invention.
Figure 2:
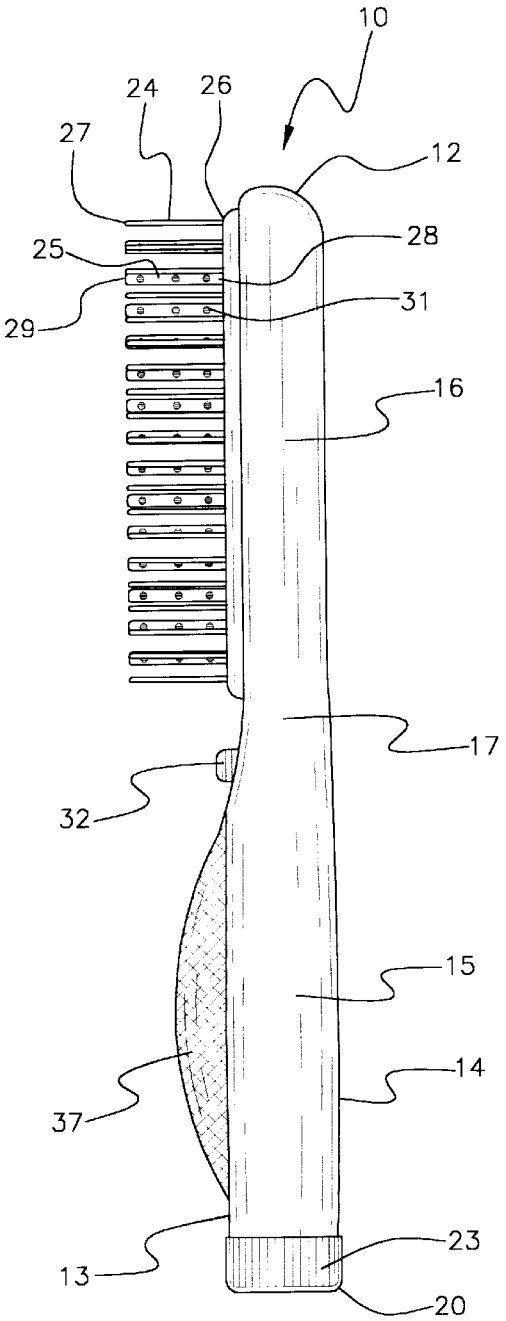
FIG. 2 is a schematic side view of the present invention.
Figure 3:
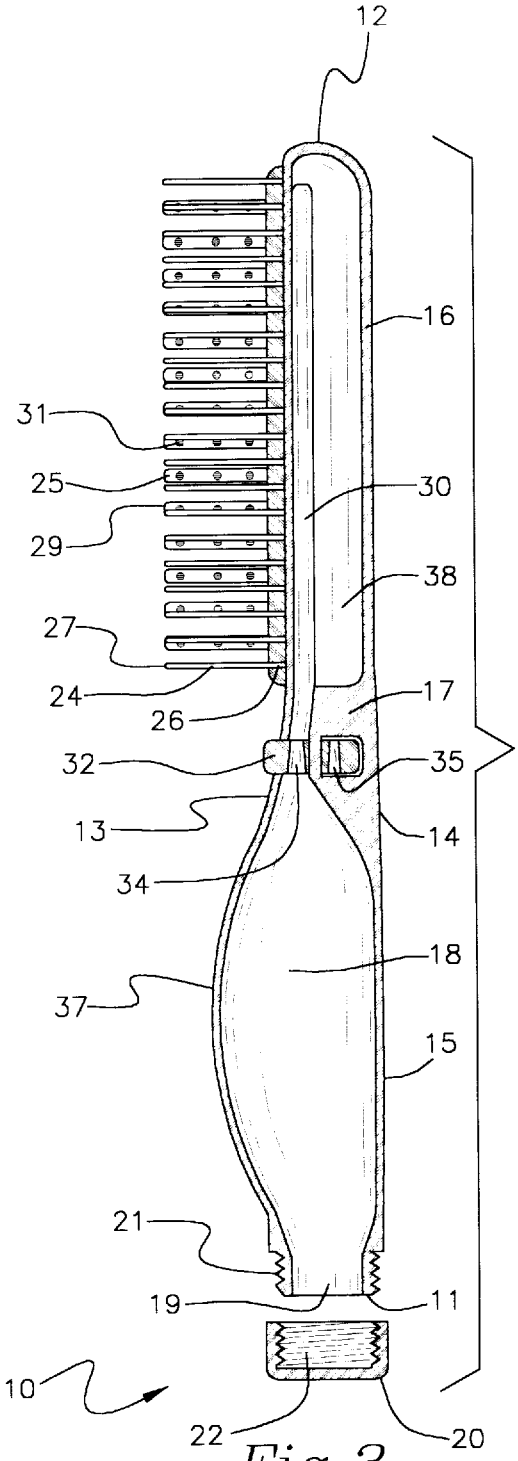
FIG. 3 is a schematic cross sectional view of the present invention taken from line 3—3 of FIG. 1.
Figure 4:
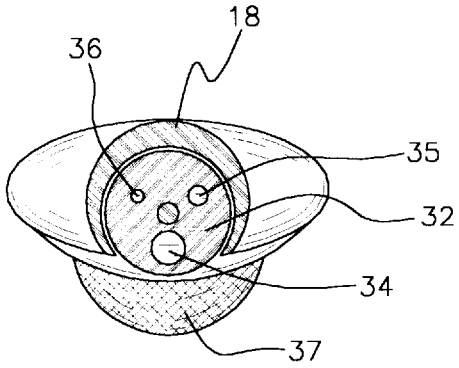
FIG. 4 is a schematic cross sectional view of the present invention taken from line 4—4 of FIG. 1.
Figure 5:
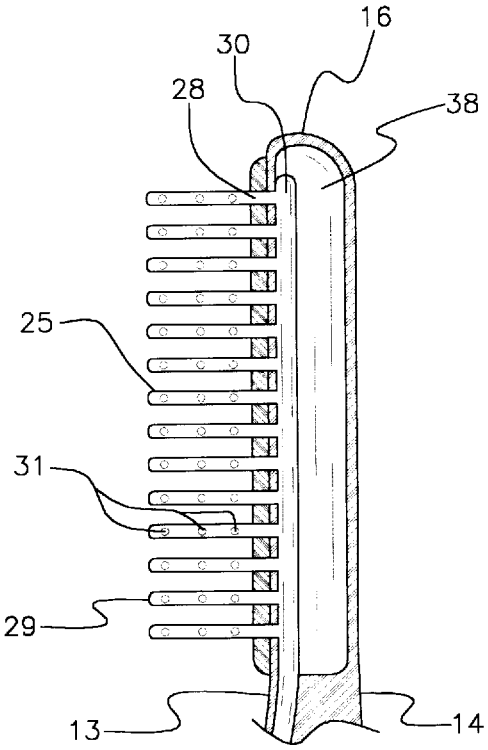
FIG. 5 is a schematic cross sectional view of the present invention taken from line 5—5 of FIG. 1.

With reference now to the drawings, and in particular to FIGS. 1 through 5 thereof, a new hair brush applicator embodying the principles and concepts of the present invention will be described.

As best illustrated in FIGS. 1 through 5, the hair brush applicator generally comprises a hair brush 10 with a handle portion 15 and a head portion 16. The handle portion 15 of the hair brush 10 has a chamber 18 therein. The head portion 16 of the hair brush 10 has a plurality of bristles outwardly extending from the front face 13 of the hair brush 10. The bristles of the head portion 16 comprise a plurality of narrow bristles 24 and a plurality of wide bristles 25. Each of the wide bristles 25 is tubular and has an open root 28 coupled to the head portion 16 and terminates at a closed tip 29. The hair brush 10 has a passage 30 therein fluidly connecting the chamber 18 adjacent the neck portion 17 to the open roots 28 of the wide bristles 25. Each of the wide bristles 25 has a plurality of lateral apertures 31 positioned between the root 28 and tip 29 of the respective wide bristle 25. The hair brush 10 has a rotatably mounted disk 32 blocking the passage 30 of the hair brush 10. The disk 32 has a plurality of bores 34,35,36 therethrough. The disk 32 is rotatable to permit selective alignment of each of the bores 34,35,36 of the disk 32 with the passage 30 of the hair brush 10 to fluidly connect the chamber 18 to the wide bristles 25 through the aligned bore.

In closer detail, the hair brush 10 has opposite proximal and distal ends 11,12, front and back faces 13,14, a handle portion 15 located adjacent the proximal end 11 of the hair brush 10, and a head portion 16 located adjacent the distal end 12 of the hair brush 10. The hair brush 10 has a longitudinal axis extending between the proximal and distal ends 11,12 of the hair brush 10. Preferably, the head portion 16 of the hair brush 10 has an interior space 38 therein occupying an area greater than one half of the area of a region defined by the exterior surface of the head portion 16. The interior space 38 of the head portion 16 is designed for reducing the weight of the hair brush 10. The hair brush 10 also preferably has a constriction between the handle and head portions 15,16 of the hair brush 10 defining a neck portion 17 of the hair brush 10. In use, the handle portion 15 of the hair brush 10 is designed for grasping by the hand of a user such that the thumb of the user is positioned adjacent the neck portion 17 of the hair brush 10.

The handle portion 15 of the hair brush 10 has a chamber 18 therein. The chamber 18 of the handle portion 15 is designed for holding a volume of a flowable hair care product therein. The proximal end 11 of the hair brush 10 preferably has an opening 19 into the chamber 18. The opening 19 of the proximal end 11 is designed for permitting filling of the chamber 18 of the handle portion 15 with flowable hair care product. An end cap 20 substantially closes the opening 19 of the proximal end 11. Preferably, the hair brush 10 has an exterior threaded region 21 around the opening 19 of the proximal end 11. The end cap 20 has an interior threaded region 22 which is threaded onto the exterior threaded region 21 of the hair brush 10 to threadably couple the end cap 20 to the proximal end 11 of the hair brush 10. Ideally, the end cap 20 has a grooved exterior surface 23 for proving a frictionally enhanced surface with respect to a substantially smooth surface for aiding turning of the end cap 20 on the proximal end 11 of the hair brush 10 to tighten and loosen the end cap 20 from the exterior threaded region 21 of the hair brush 10.

The head portion 16 of the hair brush 10 has a plurality of bristles outwardly extending from the front face 13 of the hair brush 10. The bristles of the head portion 16 include a plurality of narrow bristles 24 and a plurality of wide bristles 25. Each of the narrow bristles 24 has a root 26 coupled to the head portion 16 and terminate at a tip 27. Each of the narrow bristles 24 has a longitudinal axis extending between the root 26 and tip 27 of the respective narrow bristle 24. The longitudinal axes of the narrow bristles 24 is ideally extended generally parallel to one another and generally perpendicular to the longitudinal axis of the hair brush 10. The narrow bristles 24 are preferably arranged on the head portion 16 in a grid shaped pattern having a plurality of rows and columns. The rows of the narrow bristles 24 are extended generally parallel to one another and generally perpendicular to the longitudinal axis of the hair brush 10. The columns of the narrow bristles 24 are extended generally parallel to one another and the longitudinal axis of the hair brush 10 and generally perpendicular to the rows of narrow bristles 24. Ideally, the narrow bristles 24 are spaced apart at generally equal intervals in the columns of narrow bristles 24.

Each of the wide bristles 25 is tubular and has an open root 28 coupled to the head portion 16 and terminating at a closed tip 29. Each of the wide bristles 25 has a longitudinal axis extending between the root 28 and tip 29 of the respective wide bristle 25. The longitudinal axes of the wide bristles 25 is ideally extended generally parallel to one another and generally perpendicular to the longitudinal axis of the hair brush 10. The narrow and wide bristles 24,25 each have a generally circular transverse cross section generally perpendicular to longitudinal axis of the respective bristle. Each of the circular transverse cross sections of the bristles defines an outer diameter. The outer diameters of the narrow bristles 24 are about equal to one another and the outer diameters of the wide bristles 25 are about equal to one another. The outer diameter of a wide bristle 25 is greater than the outer diameter of a narrow bristle 24.

The wide bristles 25 are preferably arranged on the head portion 16 in a pair of columns extending generally parallel to the columns of the narrow bristles 24. Preferably, a number of the columns of narrow bristles 24 are interposed between the columns of the wide bristles 25. Ideally, the number of the columns of narrow bristles 24 comprises three columns of narrow bristles 24. The wide bristles 25 are also preferably spaced apart at generally equal intervals in the columns of wide bristles 25.

The hair brush 10 has a passage 30 therein fluidly connecting the chamber 18 adjacent the neck portion 17 to the open roots 28 of the wide bristles 25. The passage 30 is designed for permitting passage therethrough of flowable hair care product from the chamber 18 into the lumens of the wide bristles 25. Each of the wide bristles 25 has a plurality of lateral apertures 31 positioned between the root 28 and tip 29 of the respective wide bristle 25. The apertures 31 is designed for permitting passage therethrough of flowable hair care product from inside the respective wide bristle 25 to the exterior of the respective wide bristle 25.

The hair brush 10 has a rotatably mounted disk 32 blocking the passage 30 of the hair brush 10 to block passage of a flowable hair care product from the chamber 18 to the wide bristles 25 through the passage 30. The disk 32 is preferably positioned in the neck portion 17 of the hair brush 10 such that the thumb of the user may easily turn the disk 32 when the user is grasping the handle portion 15. Ideally, the disk 32 has an exterior side surface with a plurality of longitudinal ridges 33 for frictionally enhancing the exterior side surface of the disk 32 with respect to a smooth surface for aiding rotating of the disk 32 with the thumb of the user. The disk 32 has a plurality of bores 34,35,36 therethrough. The disk 32 is rotatable to permit selective alignment of each of the bores 34,35,36 of the disk 32 with the passage 30 of the hair brush 10 to fluidly connect the chamber 18 to the wide bristles 25 through the aligned bore by permitting flow of a flowable hair care product through the aligned bore of the disk 32 through the passage 30 of the hair brush 10. The bores has diameters of varying size with respect to the diameters of the other bores to permit a user to selectively control the amount of flow of a flowable hair care product from the chamber 18 to the wide bristles 25 and applied to the hair of the user. In other word, the diameter of the first bore 34 is greater than the diameters of the second bore 35 and the third bore 36. The diameter of the second bore 35 is greater than the diameter of third bore 36. Thus, the first bore 34 permits flow of a greater amount of a flowable hair care product through the passage 30 than the second and third bores 35,36 while the second bore 35 permits flow of a greater amount of a flowable hair care product through the passage 30 than the third bore 36.

Preferably, the handle portion 15 has a resiliently flexible bellows region 37 outwardly extending from the front face 13 of the hair brush 10. The flexible bellows region 37 forms a portion of the chamber 18 of the handle portion 15. In use, the flexible bellows region 37 permits squeezing of the handle portion 15 between the front and back faces 13,14 of the hair brush 10 to compress the size of the chamber 18 to force a flowable hair care product in the chamber 18 through the passage 30 of the hair brush 10. Ideally, the flexible bellows region 37 comprises a resiliently flexible rubber material more flexible than the remainder of the handle portion 15.

In an ideal illustrative embodiment, the hair brush 10 has a length defined between the proximal and distal ends 11,12 of the hair brush 10 of about 9 inches, and the head portion 16 of the hair brush 10 has a width defined generally perpendicular to the length of the hair brush 10 of about 3½ inches.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An applicator for applying a flowable hair care product on the hair and scalp of a user, said applicator comprising:

a hair brush having front and back faces, a handle portion, and a head portion;

said handle portion of said hair brush having a chamber therein, said chamber of said handle portion being for holding a volume of a flowable hair care product therein;

said head portion of said hair brush having a plurality of bristles outwardly extending from said front face of said hair brush, said bristles of said head portion comprising a plurality of narrow bristles and a plurality of wide bristles;

each of said wide bristles being tubular and having an open root coupled to said head portion and terminating at a closed tip;

said hair brush having a passage therein fluidly connecting said chamber adjacent said neck portion to said open roots of said wide bristles, said passage being for permitting passage therethrough of flowable hair care product from said chamber into said wide bristles;

each of said wide bristles having a plurality of lateral apertures positioned between said root and tip of the respective wide bristle, said apertures being for permitting passage therethrough of flowable hair care product from inside the respective wide bristle to the exterior of the respective wide bristle;

said hair brush having a rotatably mounted disk blocking said passage of said hair brush to block passage of a flowable hair care product from said chamber to said wide bristles through said passage;

said disk having a plurality of bores therethrough, said disk being rotatable to permit selective alignment of each of said bores of said disk with said passage of said hair brush to fluidly connect said chamber to said wide bristles through the aligned bore; and wherein said narrow bristles are arranged on said head portion in a grid shaped pattern having a plurality of rows and columns, said rows of said narrow bristles being extended generally parallel to one another, said columns of said narrow bristles being extended generally parallel to one another and generally perpendicular to said rows of narrow bristles.

2. The applicator of claim 1, wherein said hair brush has opposite proximal and distal ends, said handle portion being located adjacent said proximal end of said hair brush, said head portion being located adjacent said distal end of said hair brush.

3. The applicator of claim 2, wherein said proximal end of said hair brush having an opening into said chamber, said opening of said proximal end being for permitting filling of said chamber of said handle portion with flowable hair care product.

4. The applicator of claim 3, further comprising an end cap substantially closing said opening of said proximal end.

5. The applicator of claim 1, wherein said wide bristles are arranged on said head portion in a pair of columns extending generally parallel to said columns of said narrow bristles, a number of said columns of narrow bristles being interposed between said columns of said wide bristles.

6. The applicator of 5, wherein said narrow bristles are arranged on said head portion in a grid shaped pattern having a plurality of rows and columns, said rows of said narrow bristles being extended generally parallel to one another, said columns of said narrow bristles being extended generally parallel to one another and generally perpendicular to said rows of narrow bristles.

7. An applicator, comprising:

a hair brush having front and back faces, a handle portion, and a head portion;

said handle portion of said hair brush having a chamber therein, said chamber of said handle portion being for holding a volume of a flowable hair care product therein;

said head portion of said hair brush having a plurality of bristles outwardly extending from said front face of said hair brush, said bristles of said head portion comprising a plurality of narrow bristles and a plurality of wide bristles;

each of said wide bristles being tubular and having an open root coupled to said head portion and terminating at a closed tip;

said hair brush having a passage therein fluidly connecting said chamber adjacent said neck portion to said open roots of said wide bristles, said passage being for permitting passage therethrough of flowable hair care product from said chamber into said wide bristles;

each of said wide bristles having a plurality of lateral apertures positioned between said root and tip of the respective wide bristle, said apertures being for permitting passage therethrough of flowable hair care product from inside the respective wide bristle to the exterior of the respective wide bristle;

said hair brush having a rotatably mounted disk blocking said passage of said hair brush to block passage of a flowable hair care product from said chamber to said wide bristles through said passage;

said disk having a plurality of bores therethrough, said disk being rotatable to permit selective alignment of each of said bores of said disk with said passage of said hair brush to fluidly connect said chamber to said wide bristles through the aligned bore; and wherein said narrow and wide bristles each have a generally circular transverse cross section, each of said circular transverse cross sections of said bristles defining an outer diameter, wherein said outer diameters of said narrow bristles are about equal to one another, wherein said outer diameters of said wide bristles are about equal to one another, wherein said outer diameter of said wide bristle is greater than said outer diameter of said narrow bristle.

8. The applicator of claim 1, wherein said hair brush has a constriction between said handle and head portions of said hair brush defining a neck portion of said hair brush, said disk being positioned in said neck portion of said hair brush.

9. The applicator of claim 1, wherein each of said bores has a diameter, said diameter of a first bore being greater than said diameters of a second bore and a third bore, said diameter of said second bore being greater than said diameter of third bore.

10. An applicator for applying a flowable hair care product on the hair and scalp of a user, said applicator comprising:

a hair brush having opposite proximal and distal ends, front and back faces, a handle portion located adjacent said proximal end of said hair brush, and a head portion located adjacent said distal end of said hair brush, said hair brush having a longitudinal axis extending between said proximal and distal ends of said hair brush;

said hair brush having a constriction between said handle and head portions of said hair brush defining a neck portion of said hair brush;

said handle portion of said hair brush having a chamber therein, said chamber of said handle portion being for holding a volume of a flowable hair care product therein;

said proximal end of said hair brush having an opening into said chamber, said opening of said proximal end being for permitting filling of said chamber of said handle portion with flowable hair care product;

an end cap substantially closing said opening of said proximal end;

said hair brush having an exterior threaded region around said opening of said proximal end, said end cap having an interior threaded region being threaded onto said exterior threaded region of said hair brush to threadably couple said end cap to said proximal end of said hair brush;

said end cap having a grooved exterior surface for proving a frictionally enhanced surface with respect to a substantially smooth surface for aiding turning of said end cap on said proximal end of said hair brush to tighten and loosen said end cap from said exterior threaded region of said hair brush;

said head portion of said hair brush having a plurality of bristles outwardly extending from said front face of said hair brush, said bristles of said head portion comprising a plurality of narrow bristles and a plurality of wide bristles;

each of said narrow bristles having a root coupled to said head portion and terminating at a tip;

each of said narrow bristles having a longitudinal axis extending between said root and tip of the respective narrow bristle, said longitudinal axes of said narrow bristles being extended generally parallel to one another and generally perpendicular to said longitudinal axis of said hair brush;

said narrow bristles being arranged on said head portion in a grid shaped pattern having a plurality of rows and columns;

said rows of said narrow bristles being extended generally parallel to one another and generally perpendicular to said longitudinal axis of said hair brush;

said columns of said narrow bristles being extended generally parallel to one another and generally perpendicular to said rows of narrow bristles;

said narrow bristles being spaced apart at generally equal intervals in said columns of narrow bristles;

each of said wide bristles being tubular and having an open root coupled to said head portion and terminating at a closed tip;

each of said wide bristles having a longitudinal axis extending between said root and tip of the respective wide bristle, said longitudinal axes of said wide bristles being extended generally parallel to one another and generally perpendicular to said longitudinal axis of said hair brush;

said narrow and wide bristles each having a generally circular transverse cross section generally perpendicular to longitudinal axis of the respective bristle, each of said circular transverse cross sections of said bristles defining an outer diameter, wherein said outer diameters of said narrow bristles are about equal to one another, wherein said outer diameters of said wide bristles are about equal to one another, wherein said outer diameter of said wide bristle is greater than said outer diameter of said narrow bristle;

said wide bristles being arranged on said head portion in a pair of columns extending generally parallel to said columns of said narrow bristles, a number of said columns of narrow bristles being interposed between said columns of said wide bristles, wherein said number of said columns of narrow bristles comprises three columns of narrow bristles;

said wide bristles being spaced apart at generally equal intervals in said columns of wide bristles;

said hair brush having a passage therein fluidly connecting said chamber adjacent said neck portion to said open roots of said wide bristles, said passage being for permitting passage therethrough of flowable hair care product from said chamber into said wide bristles;

each of said wide bristles having a plurality of lateral apertures positioned between said root and tip of the respective wide bristle, said apertures being for permitting passage therethrough of flowable hair care product from inside the respective wide bristle to the exterior of the respective wide bristle;

said hair brush having a rotatably mounted disk blocking said passage of said hair brush to block passage of a flowable hair care product from said chamber to said wide bristles through said passage;

said disk being positioned in said neck portion of said hair brush;

said disk having a plurality of bores therethrough, said disk being rotatable to permit selective alignment of each of said bores of said disk with said passage of said hair brush to fluidly connect said chamber to said wide bristles through the aligned bore;

each of said bores having a diameter, said diameter of a first bore being greater than said diameters of a second bore and a third bore, said diameter of said second bore being greater than said diameter of third bore; and said handle portion having a flexible bellows region outwardly extending from said front face of said hair brush, said flexible bellows portion forming a portion of said chamber of said handle portion, said flexible bellows region permitting squeezing of said handle portion between said front and back faces of said hair brush to compress the size of said chamber to force a flowable hair care product in said chamber through said passage of said hair brush.

11. The applicator of claim 1, wherein said narrow and wide bristles each have a generally circular transverse cross section, each of said circular transverse cross sections of said bristles defining an outer diameter, wherein said outer diameters of said narrow bristles are about equal to one another, wherein said outer diameters of said wide bristles are about equal to one another, wherein said outer diameter of said wide bristle is greater than said outer diameter of said narrow bristle.

12. The applicator of claim 7, wherein said hair brush has opposite proximal and distal ends, said handle portion being located adjacent said proximal end of said hair brush, said head portion being located adjacent said distal end of said hair brush.

13. The applicator of claim 12, wherein said proximal end of said hair brush having an opening into said chamber, said opening of said proximal end being for permitting filling of said chamber of said handle portion with flowable hair care product.

14. The applicator of claim 13, further comprising an end cap substantially closing said opening of said proximal end.

15. The applicator of claim 5, wherein said wide bristles are arranged on said head portion in a pair of columns extending generally parallel to said columns of said narrow bristles, a number of said columns of narrow bristles being interposed between said columns of said wide bristles.

16. The applicator of claim 7, wherein said hair brush has a constriction between said handle and head portions of said hair brush defining a neck portion of said hair brush, said disk being positioned in said neck portion of said hair brush.

17. The applicator of claim 7, wherein each of said bores has a diameter, said diameter of a first bore being greater than said diameters of a second bore and a third bore, said diameter of said second bore being greater than said diameter of third bore.

* * * * *